US007466070B2

(12) United States Patent
Hong et al.

(10) Patent No.: US 7,466,070 B2
(45) Date of Patent: Dec. 16, 2008

(54) ELECTRON GUN FOR CATHODE RAY TUBE

(75) Inventors: Young-Gon Hong, Suwon-si (KR); Yeoung-Uk Nam, Suwon-si (KR); Kyou-Bong Lee, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 11/372,050

(22) Filed: Mar. 10, 2006

(65) Prior Publication Data

US 2006/0202602 A1 Sep. 14, 2006

(30) Foreign Application Priority Data

Mar. 11, 2005 (KR) ..... 10-2005-0020518

(51) Int. Cl.
*H01J 29/46* (2006.01)

(52) U.S. Cl. ..... 313/441; 313/412

(58) Field of Classification Search ..... 313/441, 313/442, 412–414, 443–445; 220/2.1 A
See application file for complete search history.

(56) References Cited

U.S. PATENT DOCUMENTS 5,015,910 A * 5/1991 Takahashi et al. ..... 313/414
5,291,094 A * 3/1994 Lee ..... 313/414
5,739,631 A * 4/1998 Tojyou et al. ..... 313/414
5,932,958 A * 8/1999 Watanabe et al. ..... 313/412
6,166,484 A * 12/2000 Okuyama et al. ..... 313/440
6,184,614 B1 * 2/2001 Uchida et al. ..... 313/414
6,313,575 B1 * 11/2001 Kimiya et al. ..... 313/414
6,400,105 B2 * 6/2002 Uchida et al. ..... 315/382
6,404,119 B1 * 6/2002 Hidaka et al. ..... 313/477 R
6,545,403 B1 * 4/2003 Lee ..... 313/414
6,597,096 B1 * 7/2003 Amano et al. ..... 313/414
2005/0218779 A1 10/2005 Jung et al.

FOREIGN PATENT DOCUMENTS

KR 1020050116263 12/2005

* cited by examiner

*Primary Examiner*—Joseph L. Williams
*Assistant Examiner*—Hana A Sanei
(74) *Attorney, Agent, or Firm*—Robert E. Bushnell, Esq.

(57) ABSTRACT

An electron gun includes a cathode adapted to emit thermal electrons, a first electrode and a second electrode adapted to form a triode portion together with the cathode, a plurality of focusing electrodes, each of said plurality of focusing electrodes being perforated by a plurality of beam passage apertures and an anode electrode, wherein a pitch between ones of said plurality of beam passage apertures of a one of said plurality of focusing electrodes arranged closest to the second electrode is smaller than a pitch between ones of said plurality of the beam passage apertures of a remaining of said plurality of focusing electrodes.

17 Claims, 9 Drawing Sheets

ELECTRON GUN FOR CATHODE RAY TUBE

CLAIM OF PRIORITY

This application makes reference to, incorporates the same herein, and claims all benefits accruing under 35 U.S.C. §119 from an application for ELECTRON GUN FOR CATHODE RAY TUBE, earlier filed in the Korean Intellectual Property Office on 11 Mar. 2005 and there duly assigned Ser. No. 10-2005-0020518.

BACKGROUND OF THE INVENTION

1. Field of the Invention

The present invention relates to an electron gun for a cathode ray tube display (CRT), and in particular, to an electron gun for a CRT that enhances the focusing characteristics by improving the image spreading of red, green and blue colors.

2. Description of Related Art

Generally, a CRT includes an electron gun for emitting electron beams, a deflection yoke for deflecting the electron beams, a shadow mask for color-selecting the electron beams, and a panel having a phosphor layer on an inner side. The electron beams emitted from the electron gun are deflected by the deflection magnetic field of the deflection yoke, and the deflected electron beams pass through the color-selecting shadow mask, followed by colliding with green, blue and red phosphors of the phosphor layer to emit light to display the desired images.

The electron gun for a CRT includes a cathode for emitting thermal electrons, a heater installed at the cathode to heat the cathode and emit thermal electrons, and a plurality of electrodes for focusing and accelerating the thermal electrons emitted from the cathode. The electrodes include first and second electrodes forming a triode portion together with the cathode, a plurality of focusing electrodes having focusing voltages applied thereto, and an anode electrode receiving a high anode voltage. The cathode, the first electrode, the second electrode, the focusing electrodes and the anode electrode are partitioned into three domains corresponding to the red, green and blue phosphors.

With the in line electron gun where the three domains are linearly arranged, the white balance image spreading occurs to a large extent due to the arrangement structure thereof, and the left and right difference occurs to a significantly extent with the electron beams placed at the left and the right sides corresponding to the red and the blue colors. For instance, for the electron beams corresponding to the red color, a relatively small beam is formed at the left side of the screen, and a relatively large beam is formed at the right screen side. Furthermore, for the electron beams corresponding to the blue color, a relatively large beam is formed at the left screen side, and a relatively small beam is formed at the right screen side. Accordingly, in the case of a white state where all the electron gun portions corresponding to the red, green and blue colors are operated, the peripheral beam focusing is deteriorated compared to that with one electron gun portion.

With the widening of the deflection angle to slim the CRT (the maximum deflection angle reaching up to 110° or more), the electron beams corresponding to the red color at the center of the screen represent the left sided image spreading, and the electron beams corresponding to the blue color represent the right sided image spreading, thereby differing from the CRT with the maximum deflection angle of 102-106°.

The electron beams corresponding to the red color at the first quadrant (the right upper side) of the screen represent the right sided image spreading, and the electron beams corresponding to the blue color represent the left sided image spreading. That is, in the case of a CRT having a widened deflection angle, the image spreading of the electron beams at the center and at the periphery of the screen is directed opposite to that of earlier CRTs. What is therefore needed is a new design for an electron gun that is better suited for the newer svelte, flat panel wide screen high deflection angle CRTs where less image spreading is produced and a higher quality image is produced.

SUMMARY OF THE INVENTION

It is therefore an object of the present invention to provide an improved design for an electron gun that is suited for high deflection angle CRTs.

It is further an object of the present invention to provide a CRT employing the novel electron gun.

It is also an object of the present invention to provide an electron gun for a CRT which improves the image spreading deviation at the periphery of a high deflection angle CRT screen.

It is yet an object of the present invention to provide a high deflection angle CRT with improved image spreading deviation at the periphery of the screen.

These and other objects may be achieved by an electron gun for a CRT that includes a cathode adapted to emit thermal electrons, a first electrode and a second electrode adapted to form a triode portion together with the cathode, a plurality of focusing electrodes, each of said plurality of focusing electrodes being perforated by a plurality of beam passage apertures and an anode electrode, wherein a pitch between ones of said plurality of beam passage apertures of a one of said plurality of focusing electrodes arranged closest to the second electrode is smaller than a pitch between ones of said plurality of the beam passage apertures of a remaining of said plurality of focusing electrodes.

The pitch between ones of the plurality of beam passage apertures perforating the one of said plurality of focusing electrodes arranged closest to the second electrode can be between 5.55 mm and 5.59 mm. A pitch between ones of said plurality of beam passage apertures perforating the remaining of said focusing electrodes can be 5.60 mm. The pitch between ones of the plurality of beam passage apertures perforating the one of said plurality of focusing electrodes arranged closest to the second electrode can be established by controlling the location of the beam passage apertures placed at the left and the right sides of the focusing electrode. The pitch of the beam passage apertures of the one of the plurality of focusing electrodes arranged closest to the second electrode can be varied by differentiating a size of a beam passage aperture placed at the center of the one of the plurality of focusing electrodes arranged closest to the second electrode from a size of the beam passage apertures arranged at the left and the right sides of the one of the plurality of focusing electrodes arranged closest to the second electrode.

A shape of the beam passage apertures arranged in the one of the plurality of focusing electrodes arranged closest to the second electrode can be one of a rectangle, an oval and a track elongated vertical to an arrangement of the beam passage apertures. A shape of the beam passage apertures arranged in the one of the plurality of focusing electrodes arranged closest to the second electrode can have a circular center and two sides extended from the circular center vertical to an arrangement of the beam passage apertures and communicated with the circular center. The extended sides of the beam passage apertures can have a shape selected from the group consisting of a rectangle, a semi-circle, and an oval.

According to another aspect of the present invention, there is provided a cathode ray tube display (CRT) that includes a panel, a funnel and a neck connected to each other to form a vacuum vessel, a phosphor layer arranged on an inner surface of the panel and having a pattern, an electron gun arranged within the neck and adapted to emit and focus electron beams, a deflection yoke arranged around an outer circumference of the funnel and adapted to deflect the electron beams emitted from the electron gun and a shadow mask arranged within the panel and adapted to color-selectively pass the electron beams emitted from the electron gun so that the electron beams land on relevant phosphors of the phosphor layer, the electron gun being as stated above.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 8:
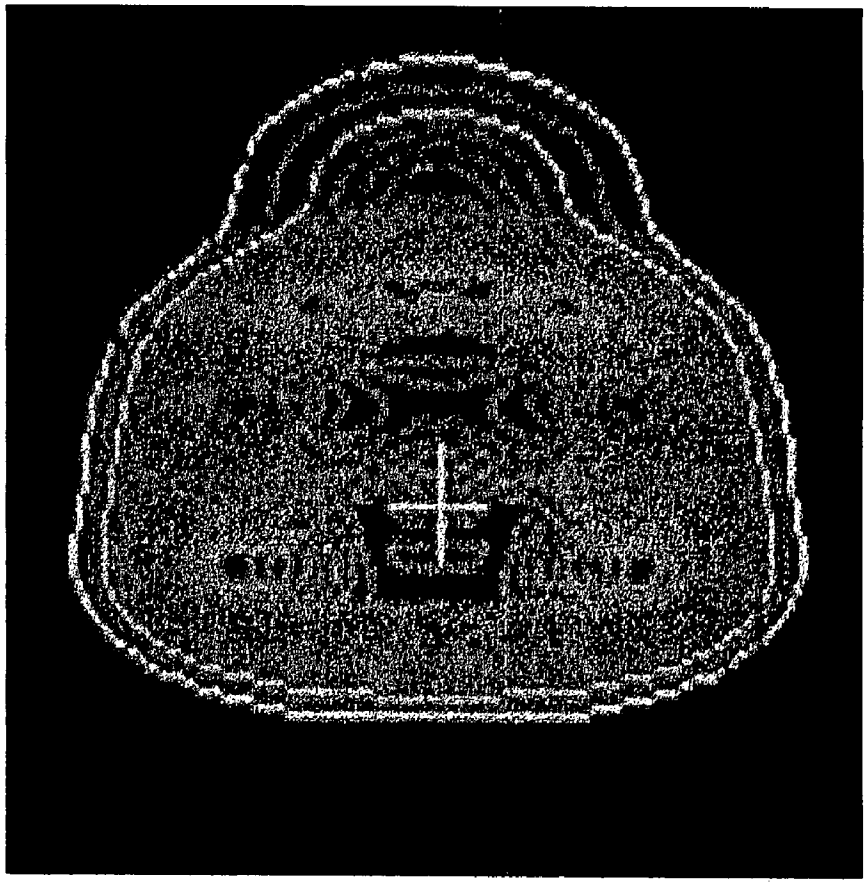
FIG. 8 is a photograph of an image of the electron beam landed on the center of a screen with an electron gun for a CRT.
Figure 9:
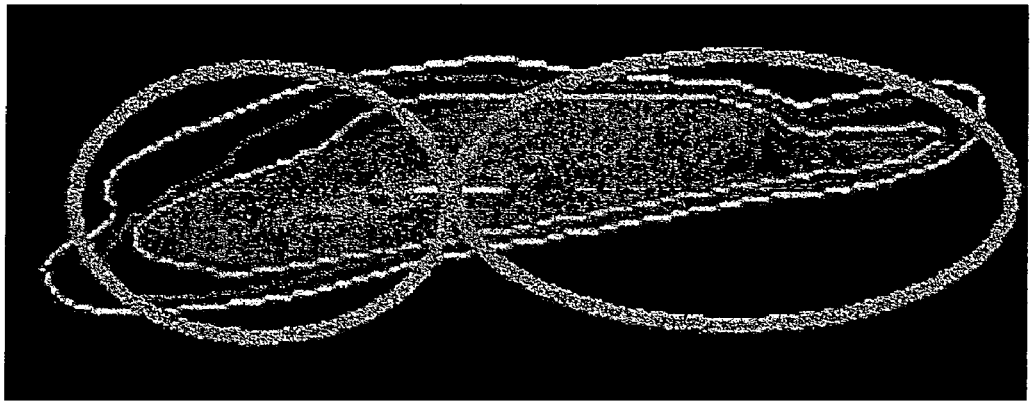
FIG. 9 is a photograph of an image of the electron beam landed on the periphery of a screen with an electron gun for a CRT.

With the widening of the deflection angle to slim the CRT up to 110° or more as shown in FIG. 8, the electron beams corresponding to the red color at the center of the screen represent the left sided image spreading, and the electron beams corresponding to the blue color represent the right sided image spreading, thereby differing from the CRT with the maximum deflection angle of 102-106°. As shown in FIG. 9, the electron beams corresponding to the red color at the first quadrant (the right upper side) of the screen represent the right sided image spreading, and the electron beams corresponding to the blue color represent the left sided image spreading. That is, in the case of a CRT with widened deflection angle, the image spreading of the electron beams at the center and at the periphery of the screen is directed opposite to that with the conventional CRT.

Figure 1:
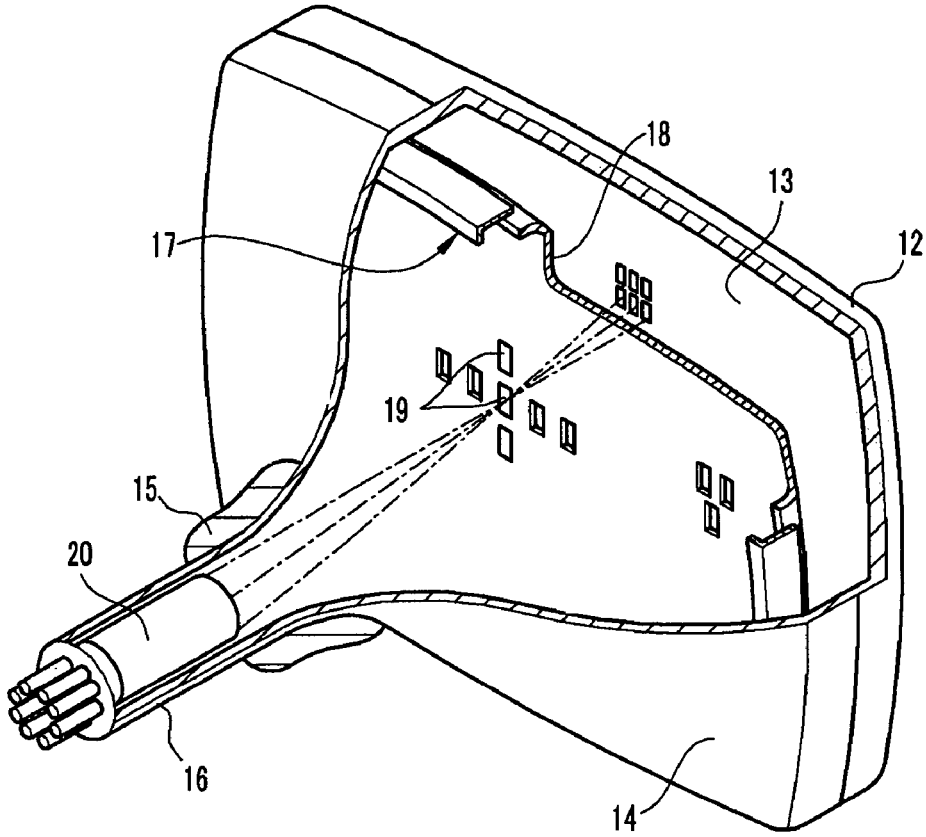
FIG. 1 is a partial sectional perspective view of a CRT according to an embodiment of the present invention.

Turning now to FIG. 1, FIG. 1 is a view of a CRT according to an embodiment of the present invention. The CRT of FIG. 1 includes a panel 12, a funnel 14 and a neck 16 serially connected to each other to form a vacuum vessel. A phosphor layer 13 is formed on the inner surface of the panel 12 with a pattern of red, blue and green phosphors. An electron gun 20 is installed in the neck 16 to emit and focus electron beams. A deflection yoke 15 is mounted around the outer circumference of the funnel 14 to deflect the electron beams emitted from the electron gun 20. A shadow mask 18 is installed within the panel 12 to color-selectively pass the electron beams emitted from the electron gun 20, allowing them to land on the phosphors of the phosphor layer 13.

The phosphor layer 13 is a circular or a rectangular dot or stripe-pattern of red R, green G and blue B phosphors on the inner surface of the panel 12 with a black matrix BM in between. The shadow mask 18 is fitted to the panel 12 via a frame 17 so that it is spaced apart from the phosphor layer 13 by a distance. A plurality of beam passage apertures 19 are formed in the shadow mask 18 and have a pattern allowing for the passage of the electron beams. In order to make the CRT slim, the deflection angle of the deflection yoke 15 is widened so that the maximum value thereof reaches 110° or more (compared to a CRT with a maximum deflection angle of 102-106°). Other structural components of the CRT are the same as those related to the common one, and detailed explanation thereof will be omitted.

With the above structured CRT, the electron beams emitted from the electron gun 20 are deflected by the deflection magnetic field produced by the deflection yoke 15. The electron beams pass through the beam passage apertures 19 of the color selecting shadow mask 18, and collide against the green, blue and red phosphors of the phosphor layer 13 so that the phosphors are excited and emit light, thus displaying the desired screen images.

Figure 2:
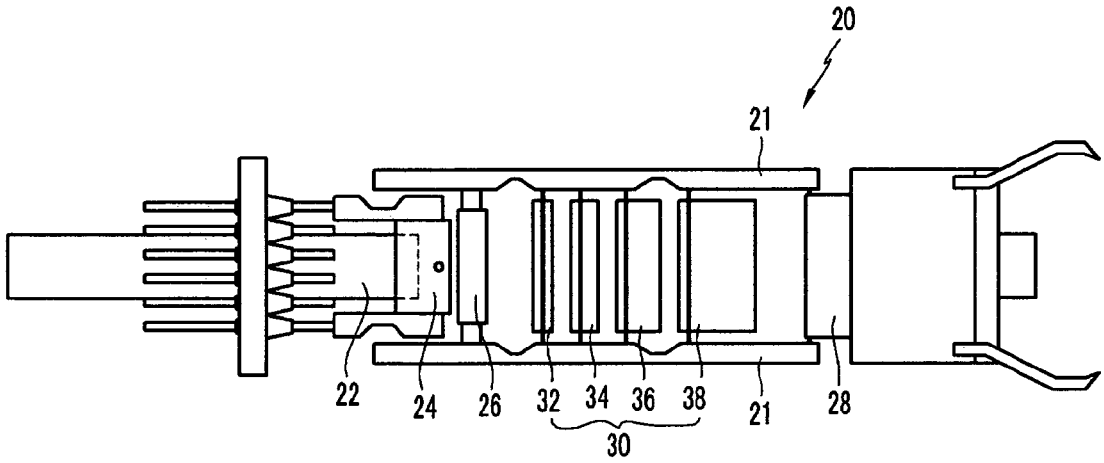
FIG. 2 is a side view of an electron gun for a CRT according to an embodiment of the present invention.
Figure 3:
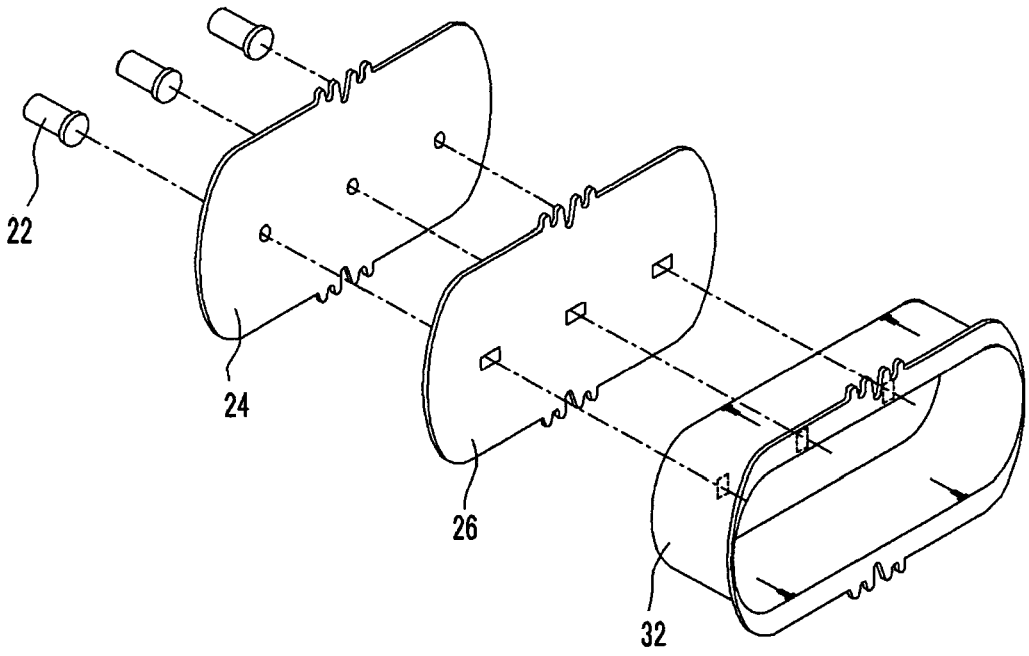
FIG. 3 is an exploded perspective view of a part of an electron gun for a CRT according to an embodiment of the present invention.

As shown in FIGS. 2 and 3, in an electron gun 20 for a CRT according to an embodiment of the present invention, the electron gun 20 includes a cathode 22 for emitting thermal electrons, first and second electrodes 24 and 26 forming a triode portion together with the cathode 22, a plurality of focusing electrodes 30, and an anode electrode 28. The first and the second electrodes 24 and 26, the plurality of focusing electrodes 30 and the anode electrode 28 are fixed to a bead glass 21. The focusing electrodes 30 can include from 2 to 8 individual electrodes.

Figure 4:
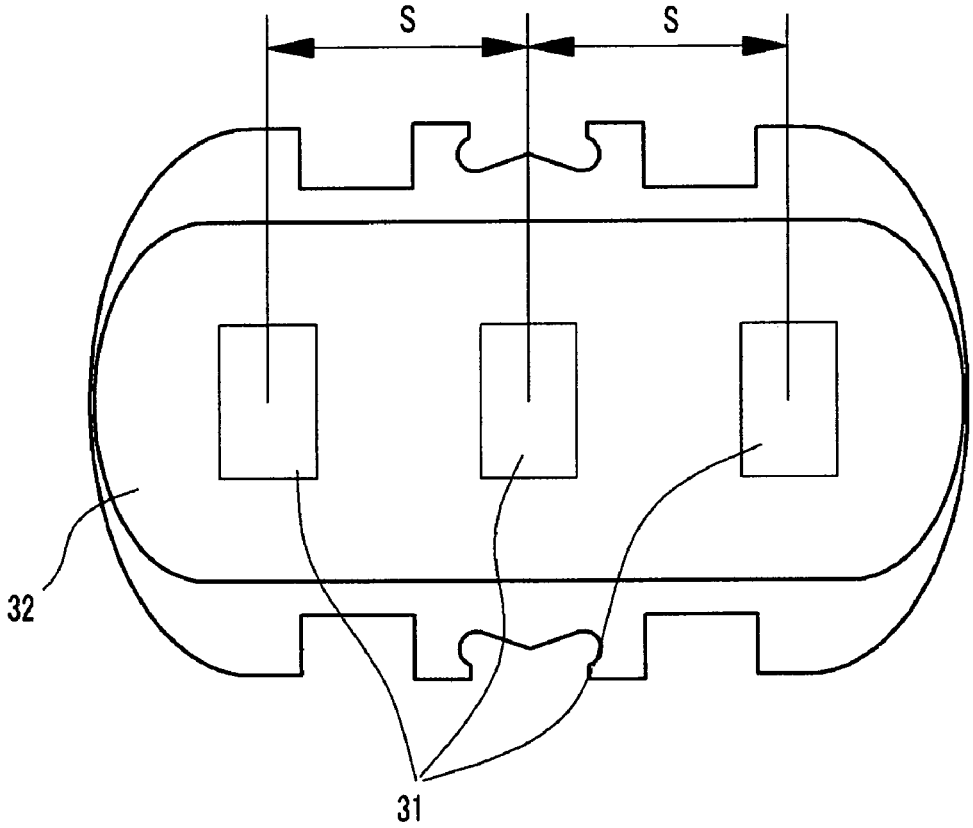
FIG. 4 is a plan view of a first focusing electrode of an electron gun for a CRT according to an embodiment of the present invention.

As shown in FIG. 4, the pitch S between the beam passage apertures 31 perforating the first focusing electrode 32 (the focusing electrode closest to the second electrode 26) is smaller than the pitch S between the beam passage apertures 31 perforating the other focusing electrodes 34, 36 and 38. The pitch S between the beam passage apertures 31 of the first focusing electrode 32 is established to satisfy the condition $5.55\ \text{mm} \leqq S \leqq 5.59\ \text{mm}$.

The pitch S between the beam passage apertures 31 refers to the distance between a center line of the beam passage aperture 31 going through the center of the focusing electrode 32 and the center lines of the beam passage apertures 31 located at the left and the right sides of the focusing electrode 32. The beam passage apertures 31 placed at the left and the right sides of the focusing electrode 32 are shaped symmetrical to each other left and right with respect to the center line of the beam passage aperture 31 going through the center of the focusing electrode 32. Regarding the focusing electrodes 34, 36 and 38 other than the first focusing electrode 32, the pitch S between the beam passage apertures 31 is established to be 5.60 mm.

In order to provide for a slim CRT, the deflection angle is widened to at least 110° so that the distance between the electron gun 20 and the phosphor layer 13 of the panel 12 (the tube length) becomes shortened. Accordingly, the electron beams are shaped at the center and at the periphery of the screen opposite to each other, and the focusing of the electron beams at the center of the screen is freely achieved by the shortened tube length. Consequently, it becomes possible to reduce the pitch S between the beam passage apertures 31 of the first focusing electrode 32, thus improving the image spreading of the electron beams at the periphery of the screen.

The pitch S between the beam passage apertures 31 of the first focusing electrode 32 is established by controlling the location of the beam passage apertures 31 placed at the left and the right sides of the first focusing electrode 32. Furthermore, the pitch S between the beam passage apertures 31 may be varied by differing the sizes of the beam passage apertures 31 located at the left and the right sides of the first focusing electrode 32 from the size of the beam passage aperture 31 placed at the center of the first focusing electrode 32. As shown in FIG. 4, the beam passage aperture 31 formed in the first focusing electrode 32 have a rectangle shape, but could instead have an oval or a track shape that is elongated in the vertical direction to the arrangement of the beam passage apertures 31.

Figure 5:
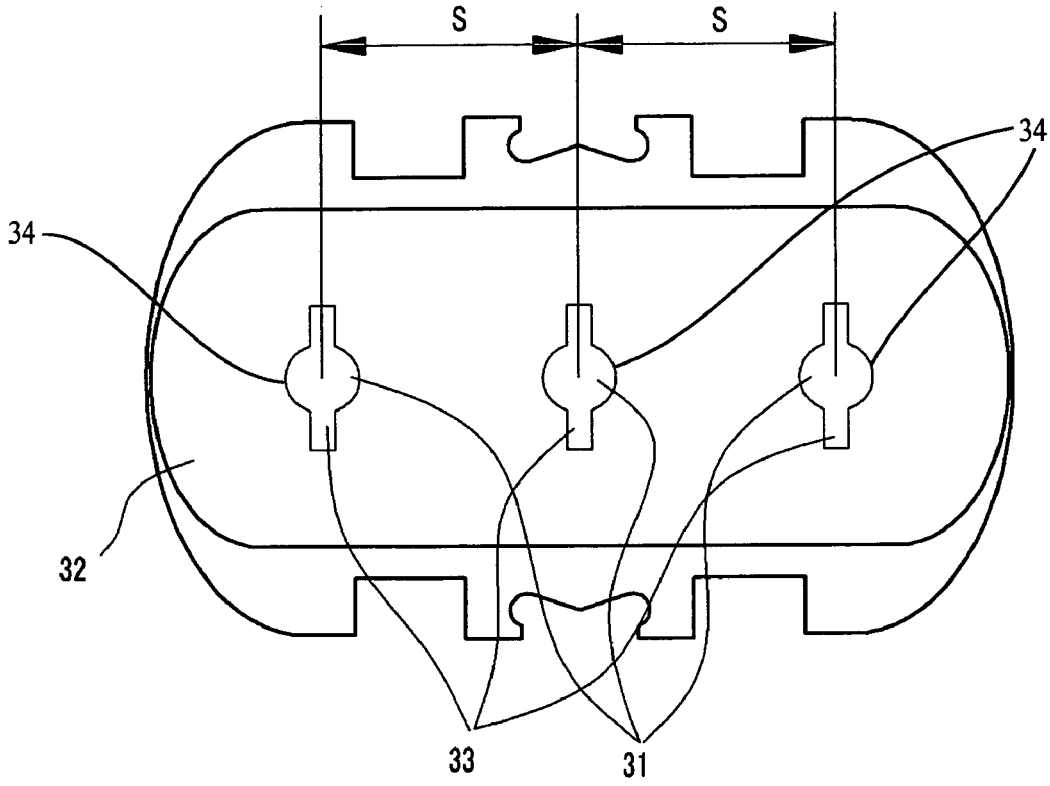
FIG. 5 is a plan view of a first focusing electrode of an electron gun for a CRT according to another embodiment of the present invention.

As shown in FIG. 5, the beam passage aperture 31 formed in the first focusing electrode 32 can have a circular center 34 and two sides 33 extending from the circular center 34 vertically to the arrangement of the beam passage apertures 31, so that they are communicated with the circular center 34. The extended sides 33 can instead take on other shapes, such as rectangular, semi-circular or oval.

Figure 6:
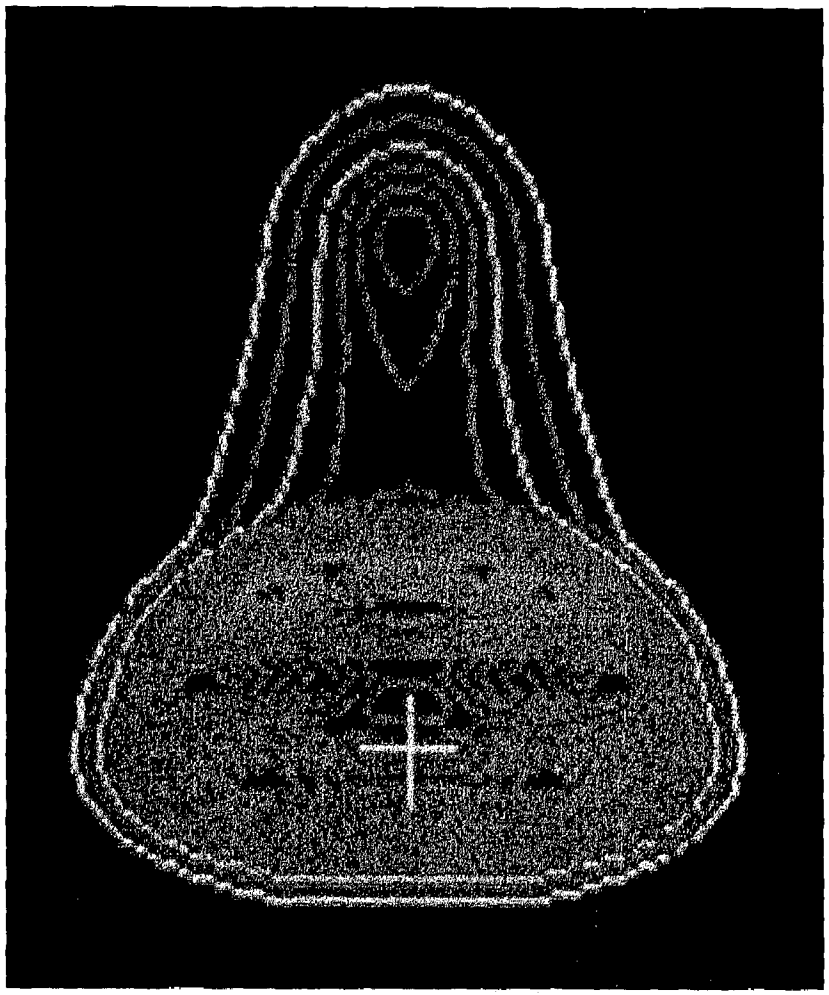
FIG. 6 is a photograph of an image of the electron beam landed on the center of a screen using an electron gun for a CRT according to an embodiment of the present invention.
Figure 7:
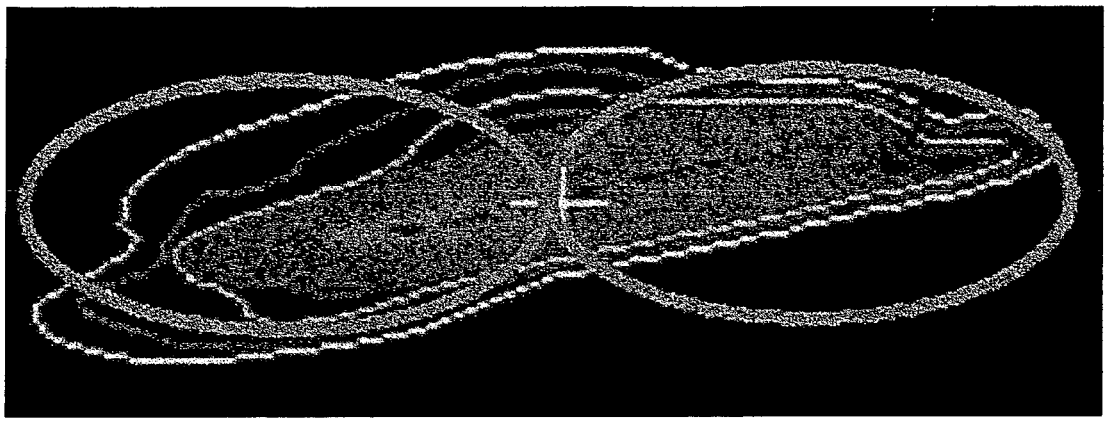
FIG. 7 is a photograph of an image of the electron beam landed on the periphery of a screen using an electron gun for a CRT according to an embodiment of the present invention.

When the pitch S and shape of the beam passage apertures 31 of the first focusing electrode 32 are designed as above, the result is the electron beams of FIGS. 6 and 7. In FIGS. 6 and 7, the electron beams corresponding to the red color at the center of the screen is increased in the left image spreading, and the electron beam corresponding to the blue color is increased in the right image spreading. By contrast, as known from the comparison between the structures shown in FIGS. 7 and 9, with the electron beams in the first quadrant (the right upper side) of the screen, the electron beam corresponding to the red color is decreased in the left image spreading, and the electron beam corresponding to the blue color is decreased in the right image spreading, thus reducing the difference between the red and the blue colors.

With the usage of the electron guns 20 where the pitch S of the beam passage apertures 31 of the first focusing electrode 32 was varied to be 5.57 mm, 5.58 mm, 5.60 mm, 5.63 mm and 5.65 mm, the image spreading of the electron beams corresponding to the red color at the center and in the first and second quadrants of the screen was measured on the left and right sides thereof around the central point, and listed in Table 1.

TABLE 1

| | Second quadrant (left upper side) | | Center | | First quadrant (right upper side) | |
|---|---|---|---|---|---|---|
| Pitch (mm) | Left | Right | Left | Right | Left | Right |
| 5.57 | 3.28 | 3.50 | 3.06 | 0.69 | 3.58 | 3.37 |
| 5.58 | 3.16 | 3.71 | 2.60 | 0.72 | 3.34 | 3.56 |
| 5.60 | 2.99 | 4.17 | 1.76 | 0.84 | 3.09 | 3.90 |
| 5.63 | 2.77 | 4.79 | 1.05 | 1.55 | 3.05 | 4.57 |
| 5.65 | 3.02 | 5.25 | 0.86 | 2.07 | 3.22 | 5.12 |

As illustrated in Table 1, as the pitch S of the beam passage apertures 31 of the first focusing electrode 32 is decreased, the left and right difference in the first and the second quadrants of the screen is significantly reduced. This can also be seen by comparing the photographs of FIGS. 9 and 7. In the electron beam image shown in FIG. 9, when the pitch S of the beam passage apertures 31 is established to be 5.63 mm, the left and the right sizes (roughly indicated by the red oval) largely differ from each other. By contrast, in the electron beam image shown in FIG. 7, when the pitch S of the beam passage apertures 31 is established to be 5.57 mm, the left and the right sizes (roughly indicated by the red oval) are similar to each other.

When the above structured electron gun is applied to the CRT where the deflection angle is increased to a maximum value of 110° or more to obtain a svelte device (compared to the maximum deflection angle of 102-106° for a CRT), the obtainable effect becomes further enhanced.

With the electron gun for a CRT according to the present invention, the pitch of the beam passage apertures of the first focusing electrode is established to be smaller than that of other focusing electrodes so that the beam spreading at the periphery of the screen can be improved. Accordingly, the electron beams corresponding to the red and the blue colors are minimized in the deviation of beam spreading, and the focusing is improved, thereby enhancing the display image quality.

Although preferred embodiments of the present invention have been described in detail hereinabove, it should be clearly understood that many variations and/or modifications of the basic inventive concept herein taught which may appear to those skilled in the art will still fall within the spirit and scope of the present invention, as defined in the appended claims.

What is claimed is:

1. An electron gun, comprising:

a cathode to emit thermal electrons;

a first electrode and a second electrode to form a triode portion together with the cathode;

a plurality of focusing electrodes, each of said plurality of focusing electrodes being perforated by a plurality of beam passage apertures; and an anode electrode, wherein a pitch between ones of said plurality of beam passage apertures of one of said plurality of focusing electrodes arranged closest to the second electrode is smaller than a pitch between ones of said plurality of the beam passage apertures of a remaining of said plurality of focusing electrodes, wherein a side of the focusing electrode arranged closest to the second electrode that faces away from the second electrode being entirely unobstructed.

2. The electron gun of claim 1, wherein the pitch between ones of the plurality of beam passage apertures perforating the one of said plurality of focusing electrodes arranged closest to the second electrode is between 5.55 mm and 5.59 mm.

3. The electron gun of claim 2, wherein the pitch between ones of the plurality of beam passage apertures perforating the one of said plurality of focusing electrodes arranged closest to the second electrode is established by controlling a location of the beam passage apertures placed at the left and the right sides of the focusing electrode.

4. The electron gun of claim 2, wherein the pitch of the beam passage apertures of the one of the plurality of focusing electrodes arranged closest to the second electrode is varied by differentiating a size of a beam passage aperture placed at the center of the one of the plurality of focusing electrodes arranged closest to the second electrode from a size of the beam passage apertures arranged at the left and the right sides of the one of the plurality of focusing electrodes arranged closest to the second electrode.

5. The electron gun of claim 2, wherein a pitch between ones of said plurality of beam passage apertures perforating the remaining of said focusing electrodes is 5.60 mm.

6. The electron gun of claim 1, wherein a shape of the beam passage apertures arranged in the one of the plurality of focusing electrodes arranged closest to the second electrode is selected from the group consisting of a rectangle, an oval and a track elongated vertical to an arrangement of the beam passage apertures.

7. The electron gun of claim 1, wherein a shape of the beam passage apertures arranged in the one of the plurality of focusing electrodes arranged closest to the second electrode comprise a circular center and two sides extended from the circular center vertical to an arrangement of the beam passage apertures and communicated with the circular center.

8. The election gun of claim 7, wherein the extended sides of the beam passage apertures comprise a shape selected from the group consisting of a rectangle, a semi-circle, and an oval.

9. The electron gun of claim 6, each of the beam passage apertures arranged in the one of the plurality of focusing electrodes arranged closest to the second electrode being of a same shape and of a same size.

10. A cathode ray tube display (CRT), comprising:

a panel, a funnel and a neck connected to each other to form a vacuum vessel;

a phosphor layer arranged on an inner surface of the panel and having a pattern;

an electron gun arranged within the neck and to emit and focus electron beams;

a deflection yoke arranged around an outer circumference of the funnel and to deflect the electron beams emitted from the electron gun; and a shadow mask arranged within the panel and to color-selectively pass the electron beams emitted from the electron gun so that the electron beams land on relevant phosphors of the phosphor layer, wherein the electron gun comprises a cathode to emit thermal electrons, a first electrode and a second electrode to form a triode portion together with the cathode, a plurality of focusing electrodes, each of said plurality of focusing electrodes being perforated by a plurality of beam passage apertures and an anode electrode, wherein a pitch between ones of said plurality of beam passage apertures of one of said plurality of focusing electrodes arranged closest to the second electrode is smaller than a pitch between ones of said plurality of the beam passage apertures of a remaining of said plurality of focusing electrodes, wherein a side of the focusing electrode arranged closest to the second electrode that faces away from the second electrode being entirely unobstructed.

11. The CRT of claim 10, wherein the pitch between ones of the plurality of beam passage apertures perforating the one of said plurality of focusing electrodes arranged closest to the second electrode is between 5.55 mm and 5.59 mm.

12. The CRT of claim 11, wherein the pitch between ones of the plurality of beam passage apertures perforating the remaining of the plurality of focusing electrodes is 5.60 mm.

13. The CRT of claim 11, wherein a shape of the beam passage apertures arranged in the one of the plurality of focusing electrodes arranged closest to the second electrode is selected from the group consisting of a rectangle, an oval and a track elongated vertical to an arrangement of the beam passage apertures.

14. The CRT of claim 11, wherein a shape of each of the beam passage apertures arranged in the one of the plurality of focusing electrodes arranged closest to the second electrode comprise a circular center and two sides extended from the circular center vertical to an arrangement of the beam passage apertures and communicated with the circular center.

15. The CRT of claim 14, wherein the extended sides of the beam passage apertures comprise a shape selected from the group consisting of a rectangle, a semi-circle and an oval.

16. The CRT of claim 10, wherein a maximum deflection angle of the electron beams deflected by the deflection yoke is at least 110°.

17. The CRT of claim 10, the one of said plurality of focusing electrodes arranged closest to the second electrode is further from the panel than a remaining of the plurality of focusing electrodes.

* * * * *